US010112766B1

(12) United States Patent
Wu

(10) Patent No.: US 10,112,766 B1
(45) Date of Patent: Oct. 30, 2018

(54) INTELLIGENT INSULATION CUP

(71) Applicant: Weiwei Wu, Hangzhou (CN)

(72) Inventor: Weiwei Wu, Hangzhou (CN)

( * ) Notice: Subject to any disclaimer, the term of this patent is extended or adjusted under 35 U.S.C. 154(b) by 0 days.

(21) Appl. No.: 15/893,581

(22) Filed: Feb. 9, 2018

(30) Foreign Application Priority Data

Nov. 6, 2017 (CN) ..... 2017 2 1463364 U

(51) Int. Cl.

| | |
|---|---|
| ***B65D 81/38*** | (2006.01) |
| ***G08B 5/36*** | (2006.01) |
| ***B65D 1/40*** | (2006.01) |
| ***B65D 1/02*** | (2006.01) |

(52) U.S. Cl.
CPC ..... *B65D 81/3837* (2013.01); *B65D 1/0215* (2013.01); *B65D 1/40* (2013.01); *G08B 5/36* (2013.01)

(58) Field of Classification Search
CPC .... B65D 81/3837; B65D 1/0215; B65D 1/40; G08B 5/36
See application file for complete search history.

(56) References Cited

U.S. PATENT DOCUMENTS

| | | | | |
|---|---|---|---|---|
| 9,814,331 | B2 * | 11/2017 | Alexander | A47G 19/027 |
| 2005/0045615 | A1 * | 3/2005 | Sanoner | A47G 19/2227 219/387 |
| 2015/0245723 | A1 * | 9/2015 | Alexander | A47G 19/027 99/483 |
| 2016/0114257 | A1 * | 4/2016 | Binder | A63H 33/18 446/175 |
| 2016/0217662 | A1 * | 7/2016 | Kashar | G04G 21/04 |

* cited by examiner

*Primary Examiner* — Sisay Yacob
(74) *Attorney, Agent, or Firm* — Wayne & Ken, LLC; Tony Hom

(57) ABSTRACT

The present disclosure relates to an intelligent insulation cup. The cup comprises an intelligent cup cover, an insulation cup body and a wireless charging base. The intelligent cup cover is in wireless connection with the charging base through a wireless transmission technology. The intelligent cup cover is formed by fixedly connecting a skull headdress, a battery accommodating cavity and a display cup cover which are arranged from top to bottom successively. The insulation cup body comprises a bottle body and a bottle bottom. The bottle body is composed of a touch-sensitive outer layer, an insulation layer and a liner successively from outside to inside. A temperature sensor is disposed on the intelligent cup cover. The wireless charging base comprises a wireless transmission unit and a time adjustment apparatus.

9 Claims, 7 Drawing Sheets

INTELLIGENT INSULATION CUP

TECHNICAL FIELD

The present disclosure relates to the technical field of insulation cups, and particularly relates to an intelligent insulation cup.

BACKGROUND

An insulation cup is a vessel to retain water, has a cover on the top and is tightly sealed. The insulation cup can delay heat dissipation of liquid such as water and the like contained in the insulation cup, so as to achieve the purpose of heat retaining. The insulation cup is a common article in the life, but a general insulation cup fails to know temperature of hot water in the insulation cup by observing or touching a shell of the insulation cup. It is easy to scald people when drinking the water, which greatly troubles the life of people. Meanwhile, because people have stronger and stronger time sense, people frequently view time. However, many people feel uncomfortable to wear a watch, so people need to view the time through a mobile phone, which is complicated.

From the prospective of the development of a thermos bottle, the heat preserving principle of the insulation cup is the same as that of the thermos bottle. The bottle is made into the cup just for convenience. There are various existing insulation cups which have a single function of heat preservation, so a user cannot intuitively perceive water temperature in the insulation cup. As a result, it is often to scald the user due to too high water temperature or the user does not know that the water is cool and may catch cold after drinking the water. The safety of the user cannot be ensured, and use performance becomes poor.

The qualities of the insulation cups on the market vary greatly. The insulation cups basically do not have the function of allowing the user to perceive the water temperature in the cups and viewing the time.

Thus, the problem to be solved by those skilled in the art is to provide an intelligent insulation cup capable of prompting the water temperature, displaying the time and providing convenience for use.

SUMMARY

In view of this, the present disclosure provides an intelligent insulation cup so that a user can intuitively perceive the temperature of liquid in an insulation cup for conveniently selecting liquid with proper temperature in time for drinking. Moreover, when the bottle body is touched, current time can be conveniently and quickly displayed so that the user can conveniently view the time. Through adoption of a wireless charging technology and a non-electric contact design, an electric shock danger can be avoided; and electronic elements are not exposed, thereby effectively preventing moist air from corroding the electronic elements.

The present disclosure discloses an intelligent insulation cup, comprising: an intelligent cup cover, an insulation cup body and a wireless charging base. The intelligent cup cover is buckled on the insulation cup body and is in wireless connection with the charging base through a wireless transmission technology. Through adoption of the wireless charging technology and the non-electric contact design, the electric shock danger can be avoided; moist air can be effectively prevented from corroding the electronic elements.

The intelligent cup cover is formed by fixedly connecting a skull headdress, a battery accommodating cavity and a display cup cover which are arranged from top to bottom successively, wherein a storage battery is disposed in the battery accommodating cavity. The storage battery can provide power guarantee for the whole apparatus, and can be repeatedly charged and discharged, so the service life is long.

The display cup cover is a bowl-shaped cavity structure, and a time-temperature display dial plate is disposed on an outer wall of a side surface; the time-temperature display dial plate is successively provided with a hour circle, a minute circle and a second circle from top to bottom; 1-24 numerical display windows are evenly distributed on the hour circle; 1-60 numerical display windows are evenly distributed on the minute circle; 60 circular display windows are evenly distributed on the second circle; and the display windows on the hour circle and the minute circle are respectively configured into different numeral shapes. When it needs to represent 12:12 and the display window with numeral shape of 12 on the hour circle illuminates, a display lamp with numeral shape of 12 on the minute also illuminates; and the circular display windows on the second circle successively illuminate clockwise one by one, so as to represent the current time. An annular lamp bead circuit board corresponding to the time-temperature display dial plate is disposed on an inner wall of the side surface of the display cup cover; the annular lamp bead circuit board is electrically connected with three-color LED lamp beads with luminous colors used to represent liquid temperature; and the three-color LED lamp beads are disposed correspondingly to the display windows. When a human body touches the bottle body, all the three-color LED lamp beads illuminate. One LED lamp bead has three luminous colors. Different luminous colors represent different temperature ranges. At 1 second after all the lamp beads illuminate, the time is displayed. Light on the hour circle, the minute circle and the second circle quickly returns to the corresponding display windows with numeral shapes in accordance with a clockwise order, so as to display the time.

A bowl-shaped sealing barrier chip and a bottom mouth plug are disposed in the cavity of the display cup cover; a plug is disposed on the top end of the bottle mouth plug, and a temperature sensor is disposed on the bottom; the temperature sensor disposed on the bottom senses temperature of vapor so as to measure the temperature of the liquid in the cup; the bowl-shaped sealing barrier chip is provided with a through hole corresponding to the plug; a jack corresponding to the plug is disposed on the top end in the cavity of the display cup cover; the plug penetrates through the through hole and is matched with the jack; the bottle mouth plug is fixedly connected with the time-temperature display dial plate; the display cup cover is buckled with the insulation cup body through the bottle mouth plug; the bottle mouth plug is connected with the insulation cup body through a thread. The bowl-shaped sealing barrier chip is fixed to the cavity of the display cup cover, and the inner cavity of the display cup cover and the bowl-shaped sealing barrier chip form a sealing cavity for sealing the annular lamp bead circuit board. The bottle mouth plug is detachably connected with the display cup cover by matching the plug with the jack. The bowl type sealing barrier chip can be fixed to form the sealing cavity, and later replacement of the storage battery and maintenance of inside electronic elements are convenient. The formed sealing cavity can insulate the control mainboard and the annular lamp bead circuit from an outside space, thereby preventing corrosion of the moist air and increasing the service life of the inside electronic elements.

The control mainboard is disposed in the sealing cavity; a wireless receiving unit, a timing unit, a temperature measurement unit, a contact sensing unit and an analysis processing unit are disposed on the control mainboard; and the control mainboard is electrically connected with the storage battery, the lamp bead circuit board and the temperature sensor respectively. When the installed wireless receiving unit is charged, electromagnetic quantity transmitted by the wireless charging base can be received, thereby forming induced current for charging; and a time adjustment instruction issued by the time adjustment apparatus in the wireless charging base can also be received and the instruction can be sent to the timing unit, thereby realizing adjustment of time. The temperature measurement unit is used to receive detecting information of the temperature sensor on the liner and display the analyzed and collated detecting information through the time-temperature display dial plate. The contact sensing unit is used to receive information fed back by the touch-sensitive outer layer and send the information to the analysis processing unit so that the analysis processing unit controls turnon and turnoff of the three-color LED lamp beads.

The insulation cup body comprises a bottle body and a bottle bottom. The bottle bottom is fixedly connected with the bottom of the bottle body. The bottle body is composed of a touch-sensitive outer layer, an insulation layer and a liner successively from outside to inside. A snakelike anti-skid substance is inlaid to the touch-sensitive outer layer, and has a decoration effect, and also can prevent skid; the touch-sensitive outer layer is electrically connected with the control mainboard (17); and a stereographic pentagram mark is inlaid to the center of the cup bottom.

The wireless charging base comprises a wireless transmission apparatus and a time adjustment apparatus. The wireless transmission apparatus and the time adjustment apparatus are electrically connected.

Preferably, in the intelligent insulation cup, luminous colors of the three-color LED lamp beads comprise red, orange and white; red represents 51° C. to 100° C.; orange represents 25° C. to 50° C.; white represents a temperature below 25° C.; and focus lampshades are disposed on the three-color LED lamp beads to prevent light rays among the three-color LED lamp beads from being refracted and causing interference. Reading requirements are based on practical confirmation.

Preferably, in the intelligent insulation cup, 144 three-color LED lamp beads are disposed on the annular lamp bead circuit board; and each of the three-color LED lamp beads is disposed correspondingly to the display windows on the time-temperature display dial plate respectively, i.e., one three-color LED lamp bead corresponds to one numeral display window.

Preferably, in the intelligent insulation cup, the time adjustment apparatus comprises an adjustment key and a time control mainboard; and the adjustment key comprises a mechanical key and a touch key.

Preferably, in the intelligent insulation cup, two circles of crystal diamonds are inlaid to the time-temperature display dial plate.

Preferably, in the intelligent insulation cup, the insulation layer comprises a vacuum insulation layer and a filling material insulation layer.

Preferably, in the intelligent insulation cup, input voltage of the wireless charging base is 220V AC utility power. A power supply has strong assembly suitability, thereby extending a serviceable range.

Preferably, in the intelligent insulation cup, an adjustment unit of the time adjustment apparatus is minute.

Preferably, in the intelligent insulation cup, the touch-sensitive outer layer is made of capacitance-touch sensing material.

It is known from the above technical solution that compared with the prior art, the present disclosure discloses an intelligent insulation cup, comprising an intelligent cup cover, an insulation cup body and a wireless charging base. The intelligent cup cover is charged through a wireless charging technology. Due to the non-electric contact design, the electric shock danger can be avoided; and moist air can be effectively prevented from corroding the electronic elements. The storage battery disposed in the battery accommodating cavity can be repeatedly charged and discharged for use, and has long service life. Moreover, even if the storage battery is damaged, the storage battery can be conveniently replaced as long as the bottle mouth plug and the display cup cover are unplugged with force. The display cup cover is a bowl type cavity structure, and the time-temperature display dial plate is disposed on the outer wall of the side surface. The time and the liquid temperature can be intuitively displayed through the light, thereby solving the problem that the user cannot view the time and the liquid temperature through the insulation cup. The bowl type sealing barrier chip disposed in the cavity of the display cup cover can insulate the annular lamp bead circuit board and the control mainboard into the sealing cavity, thereby effectively avoiding the corrosion of the moist air and prolonging the service life of the inside electronic elements. The temperature sensor disposed on the liner can detect the liquid temperature in real time, and the touch-sensitive outer layer can feed back the information to the control mainboard after the temperature sensor comes into contact with the touch-sensitive outer layer, thereby promoting the three-color LED lamp beads to illuminate. The time adjustment apparatus disposed on the wireless charging base can adjust the time in the unit of minute.

The present disclosure not only realizes intelligent use of the insulation cup, but also has strong practicality and guarantees firmness of all components, so that the user can intuitively perceive water temperature in the insulation cup to avoid a phenomenon that the user is scalded due to too high water temperature or the user drinks water with lower temperature without drinking in time and feels uncomfortable. Meanwhile, time can be displayed after the bottom body is touched, so that the user can view the time more conveniently, thereby providing convenience for the life of the user.

DESCRIPTION OF DRAWINGS

To more clearly describe the technical solutions in the embodiments of the present disclosure or in the prior art, the drawings required to be used in the description of the embodiments or the prior art will be simply presented below. Apparently, the drawings in the following description are merely embodiments of the present disclosure, and for those ordinary skilled in the art, other drawings can also be obtained according to the drawings without contributing creative labor.

Figure 1:
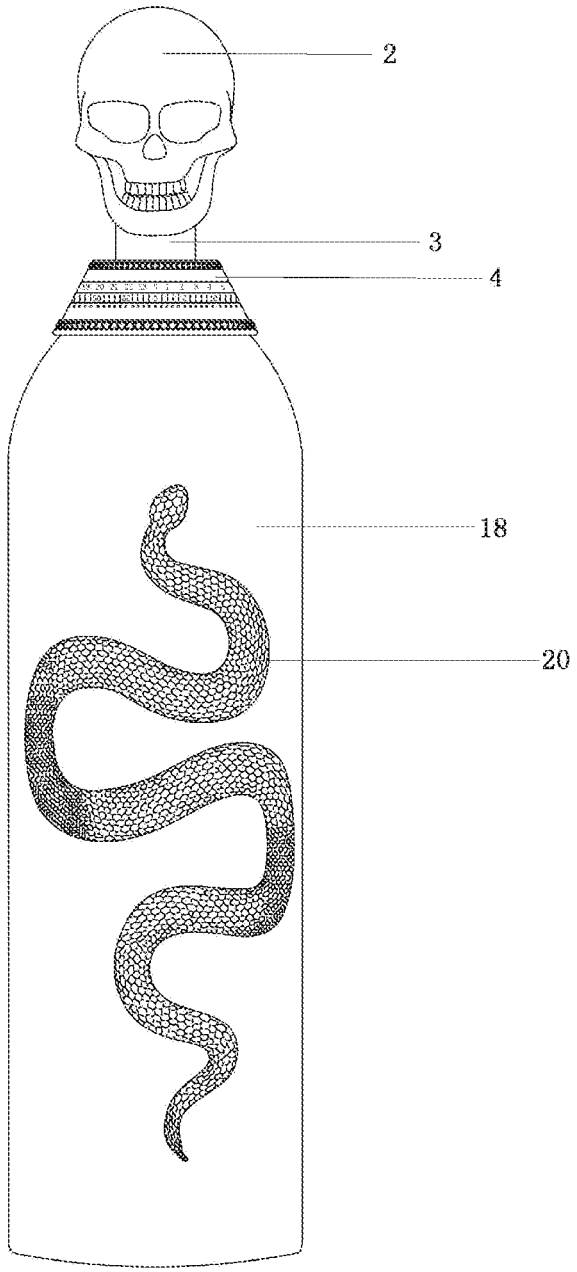
FIG. 1 is a structural schematic diagram of the present disclosure.
Figure 2:
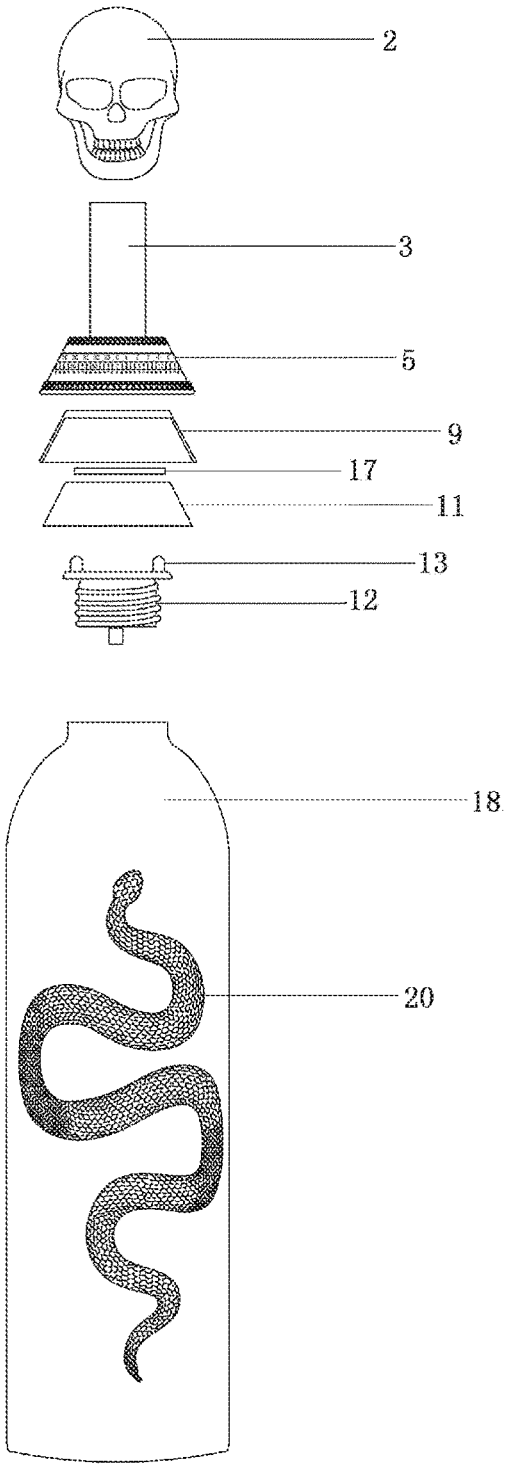
FIG. 2 is an explosion diagram of an integral structure of the present disclosure.
Figure 3:
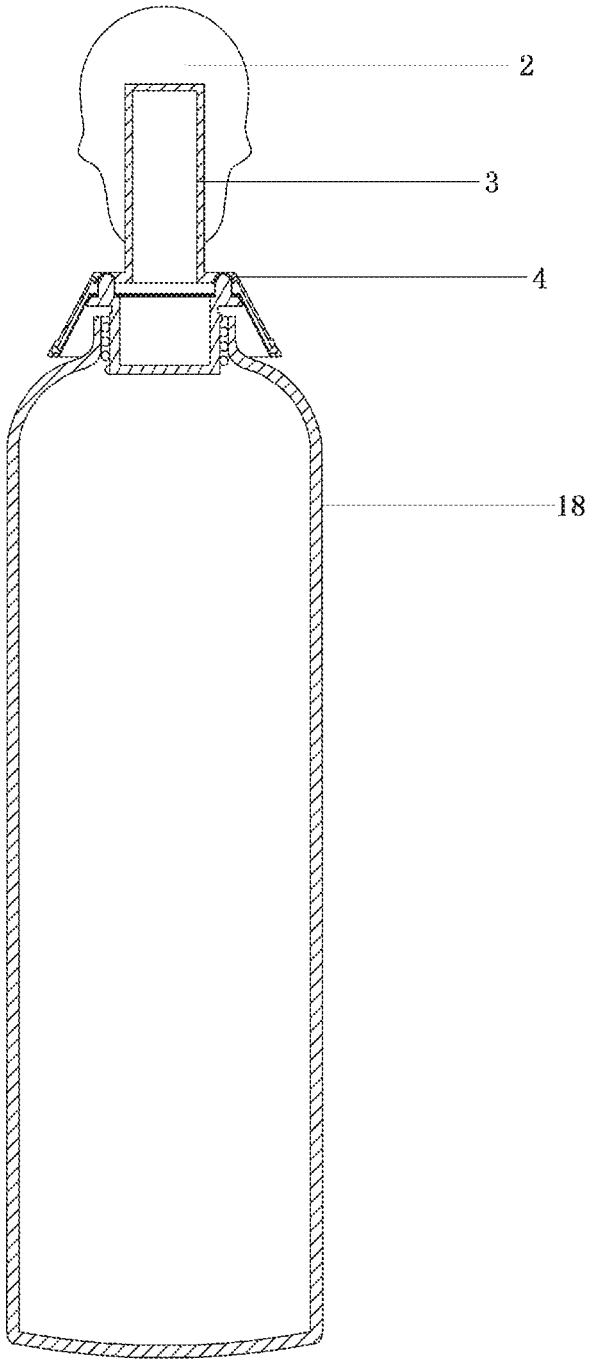
FIG. 3 is a sectional view of the present disclosure.
Figure 4:
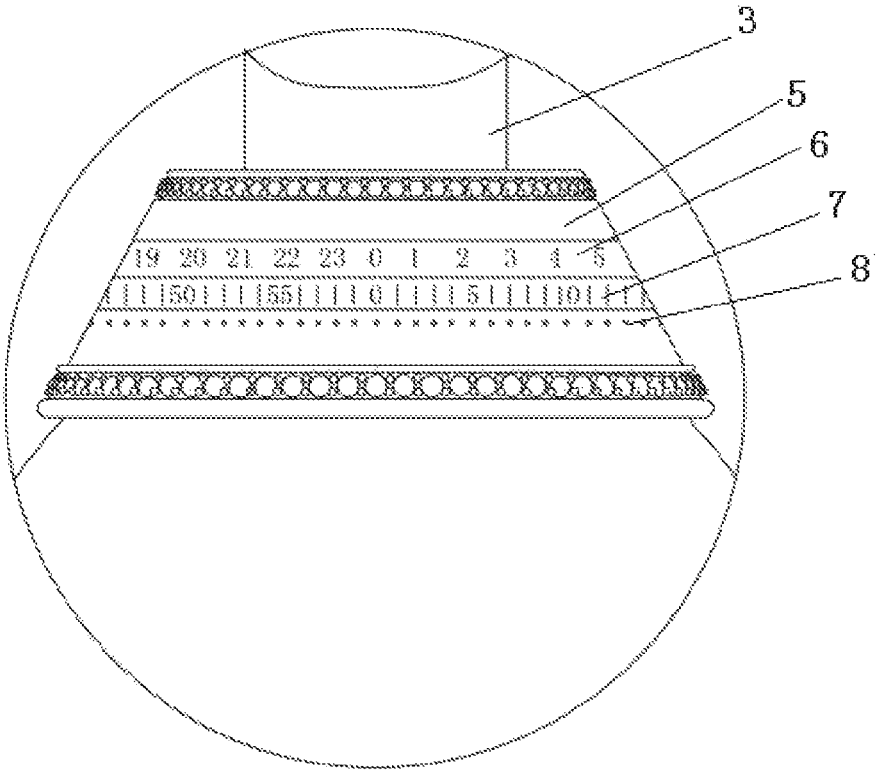
FIG. 4 is an enlarged view of a display cup cover of the present disclosure.
Figure 5:
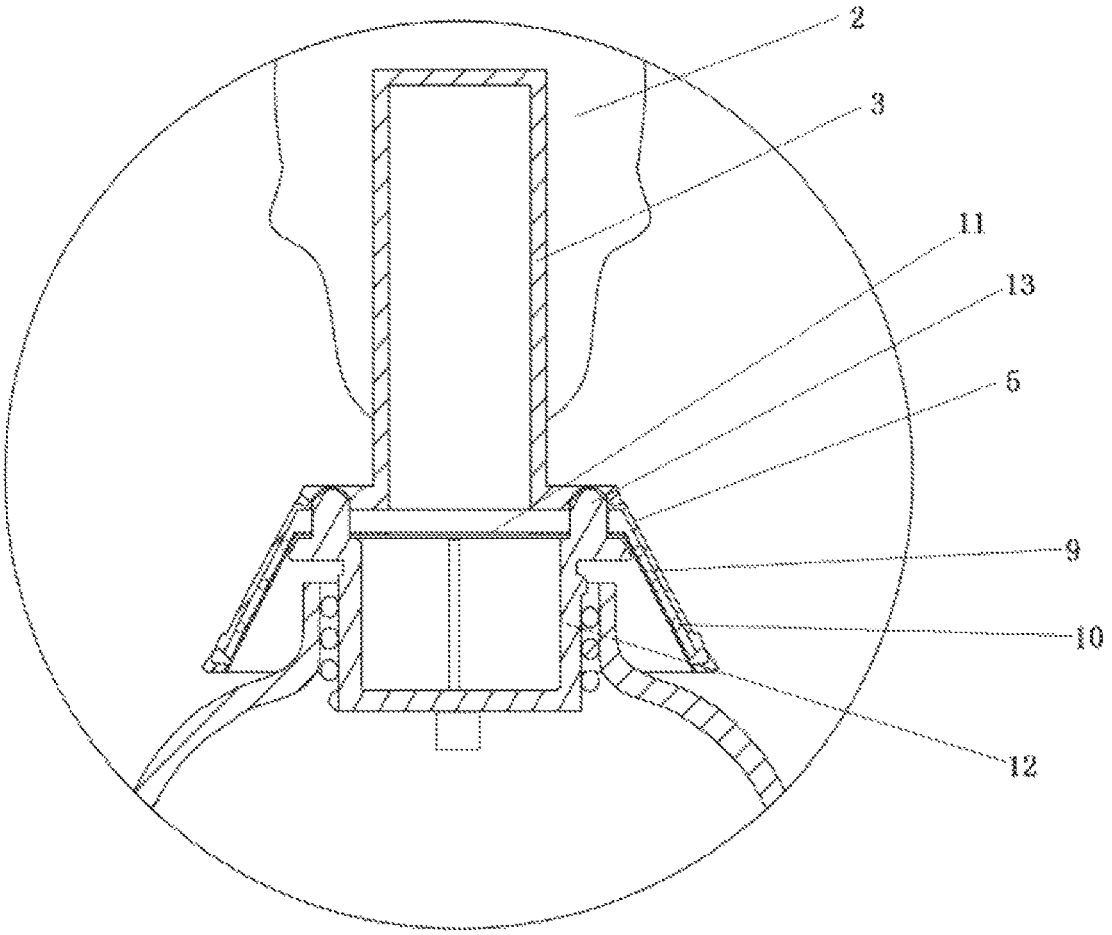
FIG. 5 is a sectional view of an intelligent cup cover of the present disclosure.
Figure 6:
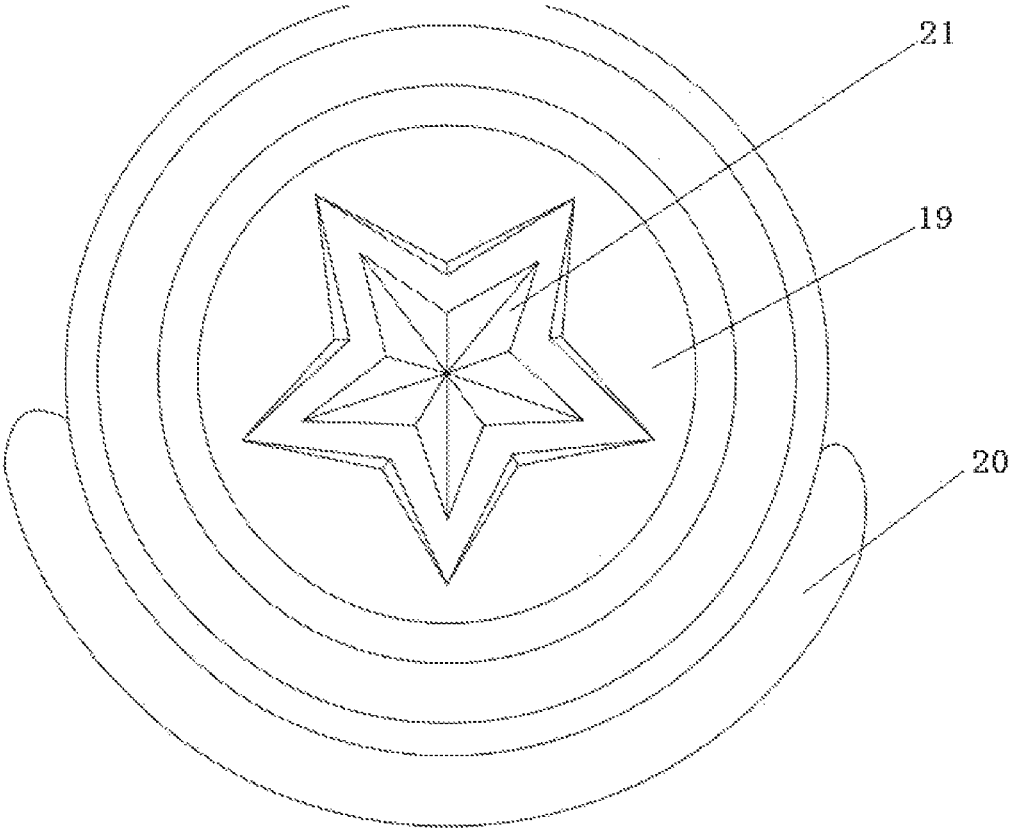
FIG. 6 is a structural schematic diagram of a cup bottom of the present disclosure.
Figure 7:
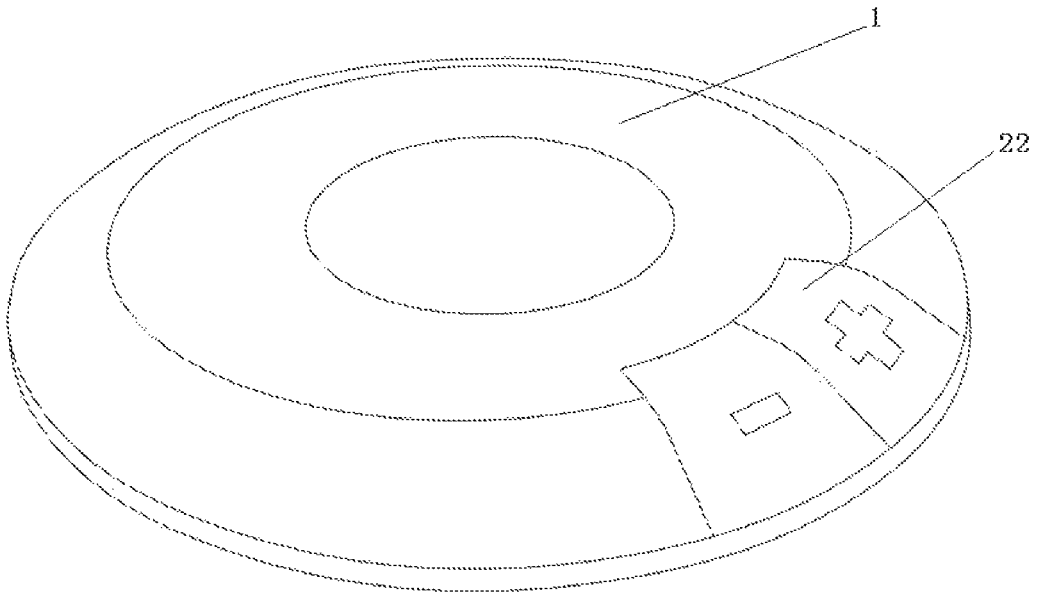
FIG. 7 is a structural schematic diagram of a wireless charging base of the present disclosure.

Numerals in the figures: 1 wireless charging; 2 skull headdress; 3 battery accommodating cavity; 4 display cup cover;

5 time-temperature display dial plate; 6 hour circle; 7 minute circle; 8 second circle; 9 annular lamp bead circuit board; 10 three-color LED lamp bead; 11 bowl-shaped sealing barrier chip; 12 bottle mouth plug; 13 plug; 17 control mainboard; 18 bottle body; 19 cup bottom; 20 snakelike anti-skid substance; 21 stereographic pentagram mark; and 22 time adjustment apparatus.

DETAILED DESCRIPTION

The technical solutions in the embodiments of the present disclosure will be clearly and fully described below in combination with the drawings in the embodiments of the present disclosure. Apparently, the described embodiments are merely part of the embodiments of the present disclosure, not all of the embodiments. Based on the embodiments in the present disclosure, all other embodiments obtained by those ordinary skilled in the art without contributing creative labor will belong to the protection scope of the present disclosure.

The embodiments of the present disclosure disclose an intelligent insulation cup so that a user can intuitively perceive the temperature of liquid in an insulation cup for conveniently selecting liquid with proper temperature in time for drinking. Moreover, when the bottle body is touched, current time can be conveniently and quickly displayed so that the user can conveniently view the time. Through adoption of a wireless charging technology and a non-electric contact design, an electric shock danger can be avoided; and electronic elements are not exposed, thereby effectively preventing moist air from corroding the electronic elements.

By referring to the drawings in the present disclosure, the present disclosure discloses an intelligent insulation cup, comprising: an intelligent cup cover, an insulation cup body and a wireless charging base 1. The intelligent cup cover is buckled on the insulation cup body and is in wireless connection with the charging base 1 through a wireless transmission technology.

The intelligent cup cover is formed by fixedly connecting a skull headdress 2, a battery accommodating cavity 3 and a display cup cover 4 which are arranged from top to bottom successively, wherein a storage battery is disposed in the battery accommodating cavity 3.

The display cup cover 4 is a bowl-shaped cavity structure, and a time-temperature display dial plate 5 is disposed on an outer wall of a side surface; the time-temperature display dial plate 5 is successively provided with a hour circle 6, a minute circle 7 and a second circle 8 from top to bottom; 1-24 numerical display windows are evenly distributed on the hour circle 6; 1-60 numerical display windows are evenly distributed on the minute circle 7; 60 circular display windows are evenly distributed on the second circle 8; an annular lamp bead circuit board 9 corresponding to the time-temperature display dial plate 5 is disposed on an inner wall of the side surface of the display cup cover 4; the annular lamp bead circuit board 9 is electrically connected with three-color LED lamp beads 10 with luminous colors used to represent liquid temperature; and the three-color LED lamp beads 10 are disposed correspondingly to the display windows.

A bowl-shaped sealing barrier chip 11 and a bottom mouth plug 12 are disposed in the cavity of the display cup cover 4; a plug 13 is disposed on the top end of the bottle mouth plug 12, and a temperature sensor is disposed on the bottom; the temperature sensor disposed on the bottom senses temperature of vapor so as to measure the temperature of the liquid in the cup; the bowl-shaped sealing barrier chip 11 is provided with a through hole corresponding to the plug 13; a jack corresponding to the plug 13 is disposed on the top end in the cavity of the display cup cover 4; the plug 13 penetrates through the through hole and is matched with the jack; the bottle mouth plug 12 is fixedly connected with the time-temperature display dial plate 5; the display cup cover 4 is buckled with the insulation cup body through the bottle mouth plug 12; and the bottle mouth plug 12 is connected with the insulation cup body through a thread. The bowl-shaped sealing barrier chip 11 is fixed to the cavity of the display cup cover 4, and the inner cavity of the display cup cover 4 and the bowl-shaped sealing barrier chip 11 form a sealing cavity for sealing the annular lamp bead circuit board 9.

A control mainboard 17 is disposed in the sealing cavity; a wireless receiving unit, a timing unit, a temperature measurement unit, a contact sensing unit and an analysis processing unit are disposed on the control mainboard 17; and the control mainboard 17 is electrically connected with the storage battery, the lamp bead circuit board 9 and the temperature sensor respectively.

The insulation cup body comprises a bottle body 18 and a bottle bottom 19; the bottle bottom 19 is fixedly connected to the bottom end of the bottle body 18; the bottle body 18 is composed of a touch-sensitive outer layer, an insulation layer and a liner successively from outside to inside; a snakelike anti-skid substance 20 is inlaid to the touch-sensitive outer layer; the touch-sensitive outer layer is electrically connected with the control mainboard 17; and a stereographic pentagram mark 21 is inlaid to the center of the cup bottom 19.

The wireless charging base 1 comprises a wireless transmission apparatus and a time adjustment apparatus 22; and the wireless transmission apparatus and the time adjustment apparatus 22 are electrically connected.

To further optimize the above-mentioned technical solution, luminous colors of the three-color LED lamp beads 10 comprise red, orange and white; red represents 51° C. to 100° C.; orange represents 25° C. to 50° C.; white represents a temperature below 25° C.; and focus lampshades are disposed on the three-color LED lamp beads 10 to prevent light rays among the three-color LED lamp beads 10 from being refracted and causing interference. Reading requirements are based on practical confirmation.

To further optimize the above-mentioned technical solution, 144 three-color LED lamp beads 10 are disposed on the annular lamp bead circuit board 9; and each of the three-color LED lamp beads 10 is disposed correspondingly to the display windows on the time-temperature display dial plate 5 respectively, i.e., one three-color LED lamp bead 10 corresponds to one numeral display window. When a human body touches the surface of the intelligent cup cover, 144 lamp beads simultaneously illuminate and illuminating light gives a prompt according to the actual temperature reading of the water. When the water temperature is greater than 50° C., the red lamp illuminates for 2 seconds; when the water temperature is less than 50° C., the orange lamp illuminates for 2 seconds; and when the water temperature is less than 25° C., the white lamp illuminates for 2 seconds. After 2 seconds, the light returns to the time. (For example, when the time is 18 o'clock, the light rapidly returns to 18 o'clock from 19 o'clock clockwise. Minute and second also return to time points in the same way.)

To further optimize the above technical solution, the time adjustment apparatus 22 comprises an adjustment key and a time control mainboard; and the adjustment key comprises a mechanical key and a touch key.

To further optimize the above technical solution, two circles of crystal diamonds are inlaid to the time-temperature display dial plate 5.

To further optimize the above technical solution, the insulation layer comprises a vacuum insulation layer and a filling material insulation layer.

To further optimize the above technical solution, input voltage of the wireless charging base 1 is 220V AC utility power. A power supply has strong assembly suitability, thereby extending a serviceable range.

To further optimize the above technical solution, an adjustment unit of the time adjustment apparatus 22 is minute.

To further optimize the above technical solution, the touch-sensitive outer layer is made of capacitance-touch sensing material.

To further optimize the above technical solution, design requirements for the charging base 1 are as follows: no interface; when the intelligent cup cover is put into the wireless charging base, charging is started. In a charging state, second makes a prompt by circling clockwise. The time adjustment apparatus of the base plate is designed to comprise an adjustment key and a time control mainboard; and the adjustment key comprises a mechanical key and a touch key, wherein the time is adjusted with "+" and "−" symbols in the touch form, and the adjustment unit of the time adjustment apparatus is minute.

To further optimize the above technical solution, waterproof levels of all components in the application are daily water proofing.

The battery accommodating cavity has a diameter of circle of 160 mm and a length of 490 mm. The display cup cover has a storage thickness of 1.1 mm.

The accommodating cavity for placing the mainboard has an inner diameter of 30 mm and a height of 185 mm.

Each embodiment in the description is described in a progressive way. The difference of each embodiment from each other is the focus of explanation. The same and similar parts among all of the embodiments can be referred to each other. For a device disclosed by the embodiments, because the device corresponds to a method disclosed by the embodiments, the device is simply described. Refer to the description of the method part for the related part.

The above description of the disclosed embodiments enables those skilled in the art to realize or use the present disclosure. Many modifications to these embodiments will be apparent to those skilled in the art. The general principle defined herein can be realized in other embodiments without departing from the spirit or scope of the present disclosure. Therefore, the present disclosure will not be limited to these embodiments shown herein, but will conform to the widest scope consistent with the principle and novel features disclosed herein.

What is claimed is:

1. An intelligent insulation cup, comprising: an intelligent cup cover, an insulation cup body and a wireless charging base (1); wherein the intelligent cup cover is buckled on the insulation cup body and is in wireless transmission connection with the wireless charging base (1);

the intelligent cup cover is formed by fixedly connecting a skull headdress (2), a battery accommodating cavity (3) and a display cup cover (4) which are arranged from top to bottom successively, wherein a storage battery is disposed in the battery accommodating cavity (3);

the display cup cover (4) is a bowl-shaped cavity structure, and a time-temperature display dial plate (5) is disposed on an outer wall of a side surface; the time-temperature display dial plate (5) is successively provided with a hour circle (6), a minute circle (7) and a second circle (8) from top to bottom; 1-24 numerical display windows are evenly distributed on the hour circle (6); 1-60 numerical display windows are evenly distributed on the minute circle (7); 60 circular display windows are evenly distributed on the second circle (8); an annular lamp bead circuit board (9) corresponding to the time-temperature display dial plate (5) is disposed on an inner wall of the side surface of the display cup cover (4); the annular lamp bead circuit board (9) is electrically connected with three-color LED lamp beads (10) with luminous colors used to represent liquid temperature; and the three-color LED lamp beads (10) are disposed correspondingly to the display windows;

a bowl-shaped sealing barrier chip (11) and a bottom mouth plug (12) are disposed in the cavity of the display cup cover (4); a plug (13) is disposed on the top end of the bottle mouth plug (12), and a temperature sensor is disposed on the bottom; the bowl-shaped sealing barrier chip (11) is provided with a through hole corresponding to the plug (13); a jack corresponding to the plug (13) is disposed on the top end in the cavity of the display cup cover (4); the plug (13) penetrates through the through hole and is matched with the jack; the bottle mouth plug (12) is fixedly connected with the time-temperature display dial plate (5); the display cup cover (4) is buckled with the insulation cup body through the bottle mouth plug (12); the bottle mouth plug (12) is connected with the insulation cup body through a thread; and the bowl-shaped sealing barrier chip (11) is fixed to the cavity of the display cup cover (4), and the inner cavity of the display cup cover (4) and the bowl-shaped sealing barrier chip (11) form a sealing cavity for sealing the annular lamp bead circuit board (9);

a control mainboard (17) is disposed in the sealing cavity; a wireless receiving unit, a timing unit, a temperature measurement unit, a contact sensing unit and an analysis processing unit are disposed on the control mainboard (17); and the control mainboard (17) is electrically connected with the storage battery, the lamp bead circuit board (9) and the temperature sensor respectively;

the insulation cup body comprises a bottle body (18) and a bottle bottom (19); the bottle bottom (19) is fixedly connected to the bottom end of the bottle body (18); the bottle body (18) is composed of a touch-sensitive outer layer, an insulation layer and a liner successively from outside to inside; a snakelike anti-skid substance (20) is inlaid to the touch-sensitive outer layer; the touch-sensitive outer layer is electrically connected with the control mainboard (17); and a stereographic pentagram mark (21) is inlaid to the center of the cup bottom (19); the wireless charging base (1) comprises a wireless transmission apparatus and a time adjustment apparatus (22); and the wireless transmission apparatus and the time adjustment apparatus (22) are electrically connected.

2. The intelligent insulation cup according to claim 1, wherein luminous colors of the three-color LED lamp beads (10) comprise red, orange and white; red represents 51° C. to 100° C.; orange represents 25° C. to 50° C.; white represents a temperature below 25° C.; and focus lampshades are disposed on the three-color LED lamp beads (10).

3. The intelligent insulation cup according to claim 1, wherein 144 three-color LED lamp beads (10) are disposed on the annular lamp bead circuit board (9); and each of the three-color LED lamp beads (10) is disposed correspondingly to the display windows on the time-temperature display dial plate (5) respectively.

4. The intelligent insulation cup according to claim 1, wherein the time adjustment apparatus (22) comprises an adjustment key and a time control mainboard; and the adjustment key comprises a mechanical key and a touch key.

5. The intelligent insulation cup according to claim 1, wherein two circles of crystal diamonds are inlaid to the time-temperature display dial plate (5).

6. The intelligent insulation cup according to claim 1, wherein the insulation layer comprises a vacuum insulation layer and a filling material insulation layer.

7. The intelligent insulation cup according to claim 1, wherein input voltage of the wireless charging base (1) is 220V AC utility power.

8. The intelligent insulation cup according to claim 1, wherein an adjustment unit of the time adjustment apparatus (22) is minute.

9. The intelligent insulation cup according to claim 1, wherein the touch-sensitive outer layer is made of capacitance-touch sensing material.

* * * * *